United States Patent [19]

Todd

[11] 4,399,889

[45] Aug. 23, 1983

[54] LOAD LOWERING APPARATUS

[76] Inventor: Walter Todd, 336 Taldan Ave., Virginia Beach, Va. 23462

[21] Appl. No.: 239,450

[22] Filed: Mar. 2, 1981

[51] Int. Cl.[3] ..... A62B 1/14; A62B 1/16

[52] U.S. Cl. ..... 182/6; 182/235; 182/193; 188/65.5

[58] Field of Search ..... 182/5, 6, 7, 3, 240, 182/72, 235, 193; 188/65.5, 65.4, 65.2, 65.1

[56] References Cited

U.S. PATENT DOCUMENTS

| | | | |
|---|---|---|---|
| 147,328 | 2/1874 | De Boucherville | 182/5 |
| 263,100 | 8/1882 | Beebe | 188/65.5 |
| 279,762 | 6/1883 | Hume | 182/5 |
| 433,481 | 8/1890 | Mansfield | 188/65.5 |
| 439,263 | 10/1890 | Zein et al. | 182/7 |
| 487,135 | 11/1892 | Stott | 188/65.3 |
| 553,190 | 1/1896 | Fowler | 182/5 |
| 594,318 | 11/1897 | Beebe | 188/65.4 |
| 641,809 | 1/1900 | Tillottson | 188/65.5 |
| 725,206 | 4/1903 | Boisclaire | 182/7 |
| 784,864 | 3/1905 | Landis | 188/65.3 |
| 974,929 | 11/1910 | Smith | 188/65.5 |
| 1,264,179 | 4/1918 | Harley | 188/65.5 |
| 1,382,341 | 6/1921 | Butterfield | 188/65.4 |
| 2,272,494 | 2/1942 | Winslow | 182/5 |
| 3,217,840 | 11/1965 | Holkesvick | 188/65.4 |
| 3,357,520 | 12/1967 | Foote | 188/65.3 |
| 4,334,595 | 6/1982 | Koch | 182/5 |

*Primary Examiner*—Reinaldo P. Machado
*Attorney, Agent, or Firm*—James L. Bean

[57] ABSTRACT

A lightweight apparatus for lowering a load at a controlled rate utilizes an elongated load-carrying strand and a slider assembly mounted on the strand to support a load for controlled downward sliding movement along the strand. The slider assembly includes a brake which is manually operable to control movement of the slider from a complete stop to substantially free fall conditions. In a preferred embodiment, the brake is spring-loaded to an intermediate position to permit a load to be lowered at a safe, relatively slow rate without actuation of the brake. When such preferred embodiment is used by a person to lower himself, a brake control lever may be manually displaced from the intermediate position to increase or decrease the rate of descent.

12 Claims, 9 Drawing Figures

FIG.1
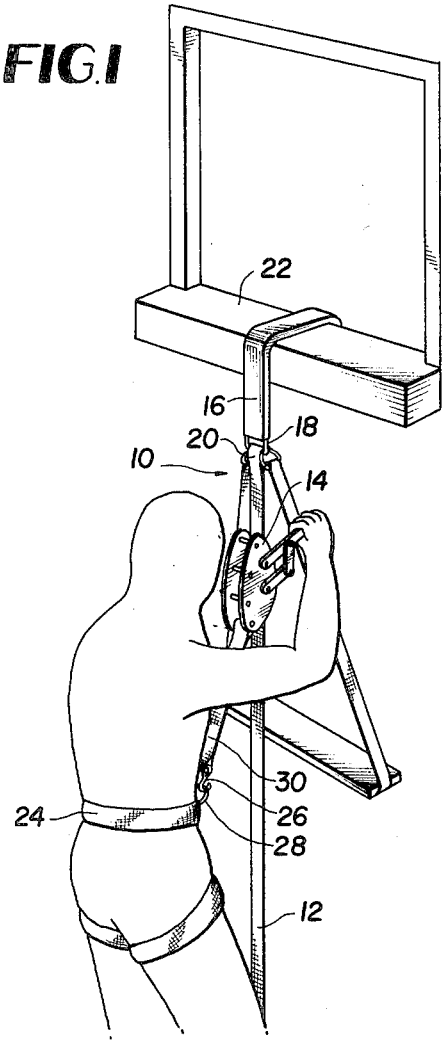
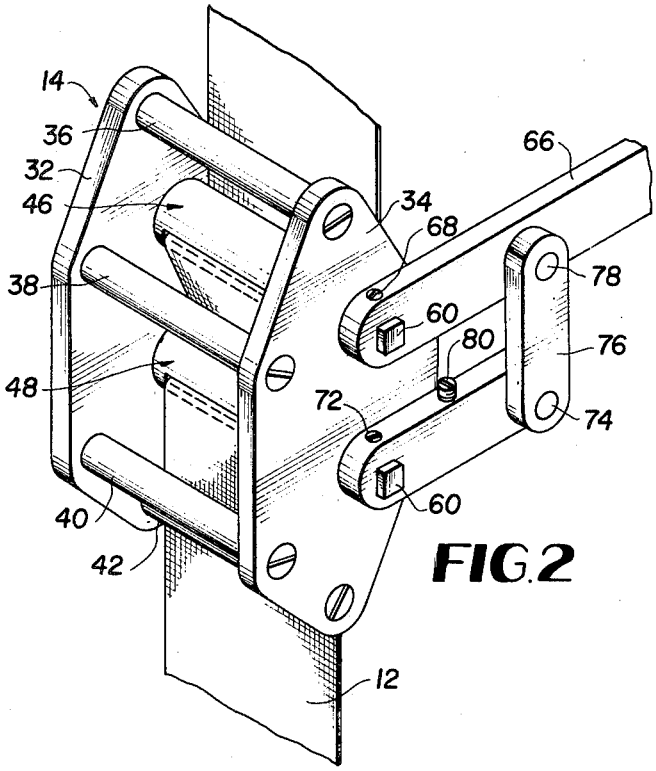
FIG.2
FIG.4
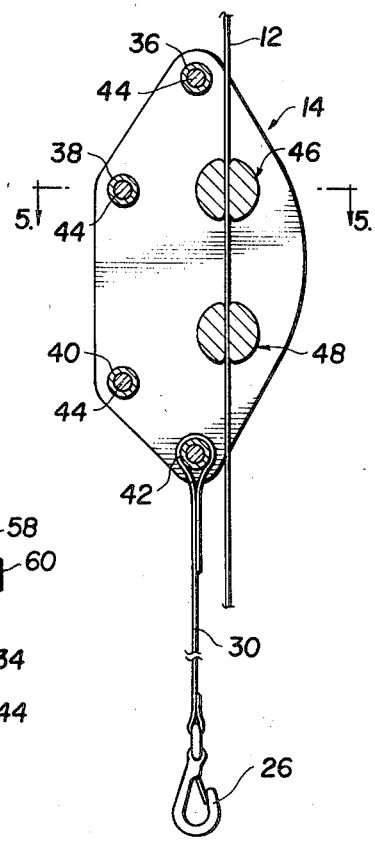
FIG.3
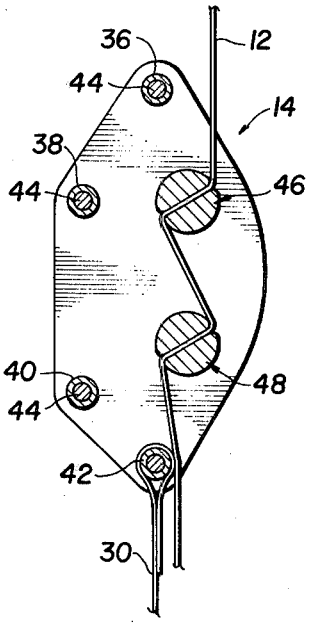
FIG.5
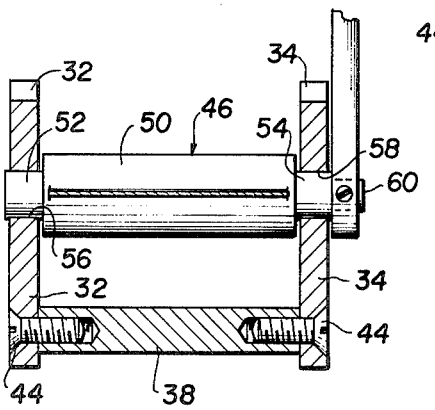

FIG.6
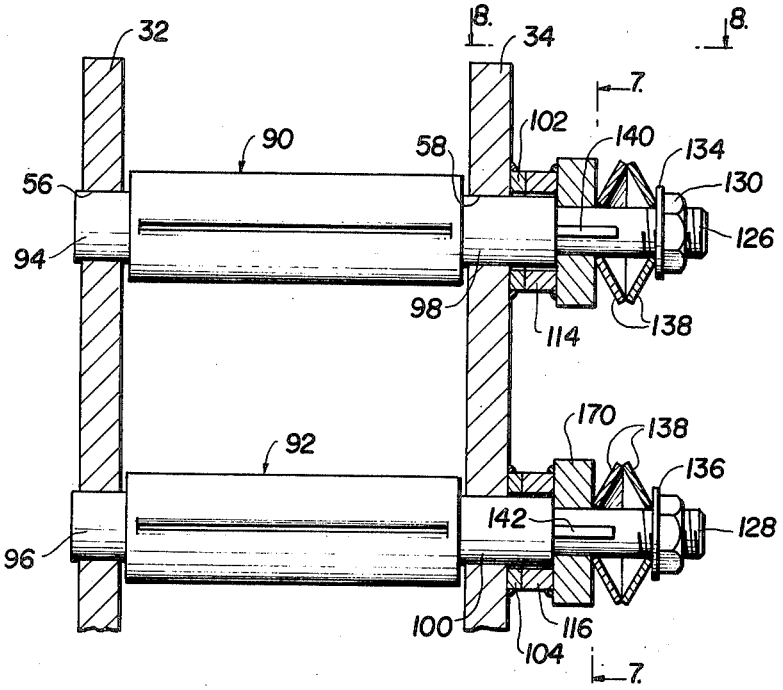
FIG.7
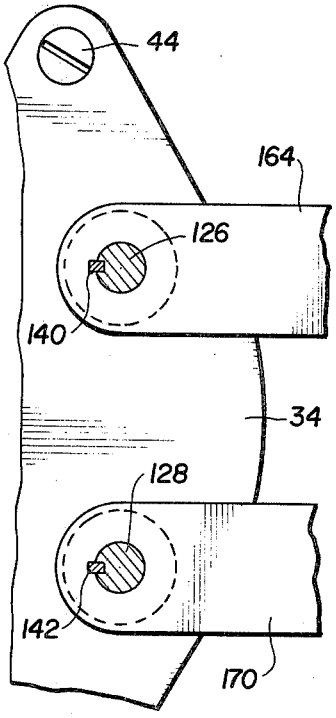
FIG.8
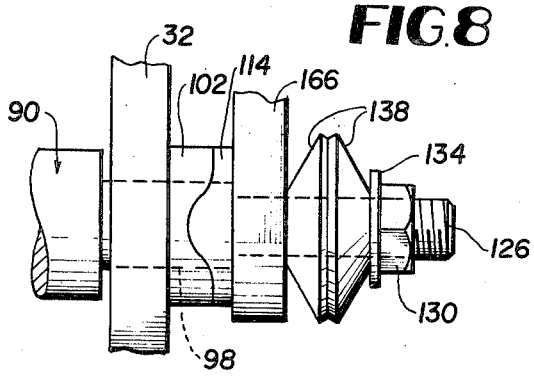
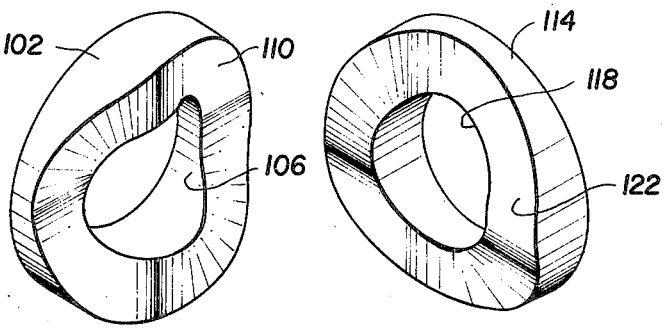
FIG.9

LOAD LOWERING APPARATUS

BACKGROUND OF THE INVENTION

1. Field of the Invention

The invention relates to apparatus for lowering loads, and more particularly to such an apparatus which may be used to lower a load at a fixed rate or which may be controlled by a person to lower himself at a variable rate.

2. Description of the Prior Art

Numerous load lowering devices have been developed which may be used by a person to lower himself from a precipitous height. Such devices are commonly used in mountain climbing, as emergency escape devices from tall buildings, and the like. Such prior devices have generally employed a slider assembly which frictionally engages and slides downwardly along a rope. It is also known to provide some means of increasing the frictional engagement or contact with the rope so that a person using the device to lower himself can slow or stop his descent, and one such device is shown in U.S. Pat. No. 3,357,520.

The prior devices have not been entirely satisfactory for various reasons. For example, frictional contact between a conventional twisted rope and a slider member moving along the rope tends to produce a twisting or turning movement which can make it difficult for a person lowering himself to maintain his orientation relative to a wall, cliff, or the like along which he is descending. Further, many such prior devices have required a person to continuously use his hands to maintain the frictional contact between the slider and the rope in order to control the rate of descent. This has presented difficulties for persons lowering themselves along structures of formations having outwardly projecting proportions such as ledges on a building which normally require use of the hands to guide safely by.

Another defect of the prior art devices is that they generally do not provide means for increasing the rate of descent where it is safe to do so or where desirable because of a hazardous atmosphere or the like, and at the same time enabling positive control of the braking apparatus to safely slow the descent.

SUMMARY OF THE INVENTION

It is the primary object of the present invention to provide an improved load lowering assembly which will avoid the drawbacks of the prior art devices mentioned above. In particular, it is an object of the present invention to provide a load lowering assembly which enables an individual to both control his rate of descent and to easily and safely stop his descent.

Another object is to provide such an improved load lowering assembly which does not have any tendency to turn as the load is lowered, thereby making it easier for a person lowering himself with the device to avoid obstructions during descent.

Another object is to provide such an improved load lowering assembly which includes control means operable to control the descent from a substantially free fall condition to a complete stop.

In the attainment of the foregoing and other objects and advantages, an important feature of the invention resides in providing an elongated, high-strength strand of nontwisting material which is adapted to have one end secured at the top of a structure or formation to be descended, and an improved slider assembly adapted to frictionally engage the strand for movement therealong to enable a controlled descent along the length of the strand. The slider assembly includes friction brake means to accurately and reliably control the rate of descent along the strand, and easily operated manual control means is provided to enable accurate control of the frictional braking force. In a preferred embodiment, the brake means is biased to an intermediate position which will slow but not stop the descent of the slider, under load, and which can manually displaced from the intermediate position to vary the rate of descent between a substantially free fall condition and a complete stop. The improved braking arrangement includes a pair of frictional elements each engaging the strand with each being rotable about a transverse axis to increase or decrease the degree of frictional contact with the strand.

BRIEF DESCRIPTION OF THE DRAWINGS

The foregoing and other objects and advantages of the invention will become apparent from the detailed description contained hereinbelow, taken in conjunction with the drawings, in which:

FIG. 1 is a perspective view illustrating a person using the load lowering device of the invention to lower himself from an opening in a building;

FIG. 2 is an enlarged perspective view of a portion of the structure shown in FIG. 1;

FIG. 3 is a vertical sectional view of the apparatus shown in FIG. 2;

FIG. 4 is a view similar to FIG. 3, with certain of the elements in an alternative position, FIG. 5 is a sectional view taken along line 5—5 of FIG. 4;

FIG. 6 is an enlarged view similar to FIG. 5 showing an alternate embodiment of the invention;

FIG. 7 is a fragmentary sectional view taken on line 7—7 of FIG. 6;

FIG. 8 is a fragmentary sectional view taken on line 8—8 of FIG. 6; and

FIG. 9 is an enlarged, exploded view of a portion of the structure shown in FIG. 8.

DESCRIPTION OF THE PREFERRED EMBODIMENTS

Referring now to the drawings in detail, a load lowering apparatus according to the present invention is designated generally by the reference number 10 and includes an elongated, high strength line 12 supporting a slider assembly 14. The line 12 is preferably in the form of a flat, woven, nontwisting strap having one end connected to a rigid, generally U-shaped hook 16, as by an eye 18 formed in hook 16 and a loop 20 and in strap 12. The rigid hook 16 is adapted to attach one end of the strap to a rigid structure at the point from which a load is to be lowered. In FIG. 1, the rigid hook 16 is shown engaging a windowsill 22 of a building with the strap 12 freely suspended from the hook outside the building.

The slider assembly 14 is mounted for sliding movement along the line 12 to movably attach a load to be lowered to the line. In FIG. 1, the load is indicated as a person attached to the slider assembly 14 by a flexible strap type body harness 24 which is releasably attached to the harness through a clasp 26 and a rigid ring 28 by a flexible belt member 30. While the load lowering apparatus is illustrated in FIG. 1 in use by an individual as a safety device to lower himself from a building, for example in case of fire, it is to be understood that the invention is not so limited as will be more fully apparent hereinbelow.

The slider assembly 14 includes a rigid, open frame structure including a pair of spaced side members, or plates, 32, 34 rigidly retained in a opposed, parallel relation by four cylindrical spacers 36, 38, 40 and 42. As illustrated in FIG. 5, screw fasteners 44 extend through openings in the side plates and are turned into threaded opening in the respective cylindrical spacers to rigidly retain the side plates in parallel laterally spaced relation.

The cylindrical spacers 36 and 42 are located substantially on the vertical centerline of the side plates at their opposed end portions with spacer cylinders 38 and 40 being located adjacent one side edge of the plates in spaced relation to one another. The plates 32 and 34 project outwardly at their side opposite the spacers 38 and 40, and a pair of vertically spaced, parallel shaft members 46, 48 extend between and are journaled for rotation by the side plates 32, 34 in this outwardly projecting area. Shafts 46 and 48 are substantially identical and accordingly only top shaft 46 will be described with reference to FIG. 5, it being understood that the description also applies to the bottom shaft 48. Thus, shaft 46 includes a cylindrical body 50 having reduced diameter extensions 52, 54 integrally formed on its end portions. The cylindrical extension 52 is journaled for rotation in an opening 56 formed in side plate 32 and extension 54 is journaled in a similar opening 58 in side plate 34. The length of the enlarged central body 50 is slightly less than the spacing between side plates 32, 34 so that shaft 46 may rotate about its horizontal axis. An axially extending, rectangular lug 60 is integrally formed on and projects outwardly from the end of the slub axle 54 for purposes to be described more fully hereinbelow.

The enlarged central body 50 of the shafts 46, 48 have an elongated thin slot 62 extending therethrough throughout a major portion of their length, with the slots 62 containing the longitudinal axis of rotation of the body portion 50. The surfaces defining the slots 62 are generally flat, substantially planar surfaces, and the slots have a thickness slightly greater than the thickness of the strap 12 and a length, longitudinally of the shaft, slightly greater than the transverse width of the strap.

As illustrated in the various views of the drawings, strap 12 passes through the slots 62 in shafts 46, 48 to mount the slider assembly 14 for downward sliding movement. Since the slots have a dimension slightly greater than the dimension of the strap, when the shafts 46, 48 are rotated to align the slots with strap 12 passing straight therethrough the slider assembly is free to move along the strap with substantially no frictional resistance. When the strap is suspended in a vertical direction as illustrated in FIG. 1 with a load supported on the slider assembly 14 by the belt 30, and the slider moving vertically down along the strap 12, the shafts 46, 48 will tend to assume a position with slots 62 vertically aligned as shown in FIG. 4 so that the slider assembly and load are free to move under substantially free fall conditions along the strap.

To reduce the rate of movement of the slider, a brake assembly is provided as illustrated in FIGS. 2 and 3. Thus, an elongated manually actuated handle 66 has one end mounted, as by set screw 68 on the rectangular lug 60 of the top shaft 46 so that movement of the handle causes rotation of the top shaft about its horizontal axis. A linkage mechanism also connects handle 66 to the lower shaft 48 so that movement of handle 66 produces corresponding rotational movement in both shafts. The linkage mechanism includes an arm 70 having one end connected, as by set screw 72, to the rectangular lug 60 on the lower shaft 48 and its other end pivotally connected, as at 74, to one end of a link 76 which, in turn, has its other end pivotally connected, as at 78 to the lever 66. Thus, the handle 66, arm 70, link 76 and side plate 34 cooperate to form a parallel linkage mechanism enabling easy, one hand control of rotation of the two shafts 46, 48. Also, the dimension of the handle 66 and of the arm 70, in a vertical plane, are such that, as the handle 66 is rotated about the axis of short 46, the handle and arm will contact each other to positively limit rotation of the shafts. Preferably, the maximum upward movement of the handle 66 is such as to prevent the slots 62 in shafts 46, 48 from reaching the completely aligned position shown in FIG. 4 so that the strap 12 will always be forced to take a slight zigzag course through the slots in the two shafts so that the shafts continuously apply at least some frictional contact with strap 12 during vertical sliding movement along the strap. Also downward movement is limited so that the shafts 46, 48 will not rotate far enough to cause the strap 12 to overlap itself on the surface of the shafts. Thus, preferably shafts 46 and 48 may be rotated through an angle substantially greater than 90 degrees but less than 180 degrees.

The extent of this minimum misalignment of the slots can be used to control the maximum rate of descent of the slider along the web for a given load. If desired, adjustable stop means, illustrated as a set screw 80 in FIG. 2, can be provided to adjust the maximum vertical movement of handle 66 and thereby adjust both the minimum and maximum possible angular misalignment of the slots in the two shafts.

A person using the apparatus, for example as a fire escape for tall buildings, puts the strap harness 24 on himself and buckles it snuggly in place. The strap 30 of the slider assembly 14 is than attached to the harness through clasp 26 and ring 28. Next, the rigid hook 16 is firmly anchored to a structural member such as the windowsill 22, and the strap 12, which preferably is stored or carried in a tightly coiled condition, is released to uncoil and hang free outside the structure. The person then lowers himself over the windowsill and, with one hand holding the handle 66 down to provide maximum braking friction between the rotable shafts 46, 48 and the strap 12, permits his weight to be supported on the strap 30. Once the person is supported on the slider assembly and has properly oriented himself facing the structure, he can lower himself at any desired rate up to the maximum permitted by the minimum misalignment angle, mentioned above, by lifting the handle 66 to bring the slots in shafts more closely to vertical alignment. During the descent, only one hand is required on the handle, leaving the feet and the other hand free to assist in maneuvering away from a wall or by any obstructions during descent.

The simplified apparatus described thus far would be useful and perhaps the preferred embodiment of the invention when used by trained persons such as firemen or persons having the physical strength and athletic ability to easily lower themselves over a windowsill, a ledge, or the like. However, for others it may be desirable to provide means to facilitate lowering oneself over a ledge or the like. This may be accomplished by providing suitable step means attached to the rigid eye 18 on the hook 16. As illustrated in FIG. 1, the step means may be in the form of a lightweight, rigid step 82 suspended below the rigid hook 16 by a pair of flexible strap members 84, 86 each having one end secured to an end of the step 82 and its other end secured to the eye 18. Thus, the person using the apparatus can initially seat himself on the windowsill, then place his feet on the step and move out of the window and position himself for descent before transferring his weight from the step to the slider mechanism. Alternatively, a short rope ladder or other means may be used to enable the person to climb down a short distance while adjusting or testing the brake.

An alternate embodiment of the invention which may be used by a person to lower himself as described above or alternatively to lower dead weight loads is shown in FIGS. 6–9. This embodiment is particularly well adapted for use by firemen who may find it necessary to lower person who are physically or mentally incapable of manipulating the handle 66 to control their own descent. This is made possible by spring loading the brake means to an intermediate position at which sufficient frictional braking action is produced between the brake shafts and the load support strap to permit a continuous descent at a safe rate. The handle can still be actuated to increase or decrease the rate of descent, as desired, to enable use by a person in the manner described above.

In the embodiment of FIGS. 6–9 the basic slider structure is similar to that described above with reference to slider 14 and this structure will therefore be described only to the extent required to understand the operation of the brake biasing means.

As best seen in FIG. 6, the upper and lower cylindrical brake shafts 90, 92, respectivey, are quite similar to shafts 46 and 48, respectively. Thus, shafts 90, 92 include integrally formed, cylindrical stub axles 94, 96, respectively, journaled one in each of the openings 56 of side plate 32 and similar, but somewhat longer stub axles 98, 100, respectively, journaled one in each of the openings 58 of side plate 34 with stub axles 98, 100 projecting outwardly from the outer surface of side plate 34. A pair of identical cam members 102, 104 having axial bores 106, 108, respectively, formed therein are rigidly mounted, as by welding, on the outer surface of side plate 34 with the axial bores being in alignment one with each of the openings 58 in the side plate. Cam members 102, 104, respectively have axial cam surfaces 110, 112 on their outwardly directed faces which are adapted to engage and cooperate with opposing cam surfaces 114, 116 on a second pair of cam members 118, 120 rigidly mounted as by welding, on the ends of handle 166 and arm 170, respectively. Cam members 118, 120 have circular bores 122, 124, respectively, extending therethrough with the diameter bores 122, 124 being equal to or slightly greater than the diameter of opening 58 in the side plate 34. Cams 118, 120 are mounted with the openings 104, 108 in alignment with the openings in the ends of handle 166 and arm 170, respectively, which receive the cylindrical extensions 126, 128 formed on the ends of stub axles 98, 100, respectively.

The ends of shaft extensions 126, 128 are threaded as seen in FIGS. 6 and 8, and a pair of nuts 130, 132 respectively and a pair of flat washers 134, 136, respectively are mounted on the threaded ends of extensions 126 and 128. The length of the threaded portions of extensions 126, 128 is such that the washers do not bear upon the handle 166 or arm 170, but rather the washers are spaced outwardly therefrom so that the handle and arm can move, within limits, axially along the extensions. This movement is opposed by spring means such as the belleville washers 138 between the flat washers 130, 132 and the handle and arm, respectively, to normally resiliently urge these members in the direction to firmly engage the cam surface 122 into contact with the opposed, complimentary cam surface 110 and cam surface 124 into contact with the opposed complimentary cam surface 112.

The contacting cam surfaces are designed so that the spring load normally urges the respective cam surfaces to rotate relative to one another to a position moving the handle 166 and arm 170 to an intermediate position corresponding generally to that shown in FIG. 3. In this position, a predetermined minimum braking force will be applied to resist movement of the slider along the strap. The spring force is such as to normally retain the assembly in this position for loads within a predetermined range such, for example, as might be expected to be encountered in lowering persons within a given weight range when the apparatus is used as a fire escape. At the same time, manual force applied to the handle 166, acting through the cooperating cam surfaces, can cause compression of the spring means and permit rotation of the respective shafts. Rotation of the handle 160 on shaft 90, and of arm 170 on shaft 192 is prevented by keys 140, 142, respectively.

The mechanical advantage provided by the handle 166 enables the rotation to be accomplished with a relatively small force. Although various spring means may be employed, the belleville washers illustrated in FIGS. 6 and 8 are preferred in that more accurate control is provided while requiring only a relatively small axial movement to vary the frictional force as desired.

It should be understood that various modification to the apparatus could readily be made without departing from the invention concept. Accordingly, while I have disclosed and described preferred embodiments of the invention, I wish it understood that I do not intend to be restricted solely thereto, but that I do intend to include all embodiments thereof which would be apparent to one skilled in the art and which come within the spirit and scope of my invention.

I claim:

1. In a load lowering mechanism of the type employed to lower a load along a generally vertical load supporting line by a slider mechanism including manually operable brake means for frictionally engaging the line to slow the rate of movement of the slider along the line, the improvement wherein said slider assembly comprises, a rigid open frame including a pair of opposed laterally spaced side members, fastener means rigidly securing said side members in said opposed laterally spaced relation, harness means for supporting a load for attachment to said slider assembly, cooperating fastener means on said harness means and said slider assembly operable to releasably attach said harness means to the slider means for movement therewith, a pair of parallel, vertically spaced shaft members each having opposed ends mounted one on each of said side members for rotation about a fixed, generally horizontal axis and each having a line-receiving opening extending substantially diametrically therethrough, the line extending through said line receiving opening in each said shaft member whereby said slider assembly is slidably mounted on the line, said line receiving openings being dimensioned to enable the line to pass freely therethrough, and handle means operably connected with said pair of shaft members and being manually operable to rotate said shaft members through a limited angle of rotation whereby frictional contact between said pair of shaft members and the line passing therethrough may be varied, said handle means including first and second link members rotatably fixed one on one end of each said shaft member, and a third link member pivotally connected to said first and second link members, said first, second and third link members cooperating with said frame to define a parallel linkage which is operable to simultaneously rotate each of said shaft members between a first position in which said line receiving openings extend in substantially vertical alignment with the load supporting line extending therethrough in a generally straight line and a second position in which said line receiving openings in said shaft members are substantially misaligned, with the load supporting line following a zigzag path therethrough.

2. The load lowering mechanism according to claim 1 wherein said shaft members are rotated through an angle in excess of 90 degrees and less than 180 degrees during movement between said first and said second positions.

3. The load lowering mechanism according to claim 2 wherein said handle means further comprises means for adjusting the maximum angle of rotation of said shaft members.

4. The load lowering mechanism according to claim 3 wherein the load supporting line is a relatively thin flat belt and wherein the line receiving openings formed in said shaft members comprises an elongated thin slot extending through said shaft members and containing the axis of rotation thereof.

5. The load lowering mechanism according to claim 1 wherein the load supporting line is a relatively thin flat belt and wherein the line receiving openings formed in said shaft means comprises an elongated thin slot extending through said shaft means and containing the axis of rotation thereof.

6. In a load lowering mechanism of the type employed to lower a load along a generally vertical load supporting line by a slider mechanism including manually operable brake means for frictionally engaging the line to slow the rate of movement of the slider along the line, the improvement wherein said slider assembly comprises, a rigid open frame including a pair of opposed laterally spaced side members, fastener means rigidly securing said side members in said opposed laterally spaced relation, harness means for supporting a load for attachment to said slider assembly, cooperating fastener means on said harness means and said slider assembly operable to releasably attach said harness means to the slider means for movement therewith, horizontal shaft means extending between and journaled for rotation in openings in said spaced side members, line receiving opening means formed in and extending substantially diametrically through said shaft means between said side members, the line extending through said opening means whereby said slider assembly is slidably mounted on the line, said opening means being dimensioned to enable the line to pass freely therethrough, handle means operably connected with said shaft means, said handle means being manually operable to rotate said shaft means between a first position in which the load supporting line passes through the opening means with minimal frictional contact therebetween, and the second position in which the load supporting line passes through said opening means with a maximum frictional contact therebetween, and resilient means normally biasing said shaft means to a third position intermediate said first and second positions, the frictional contact between the load supporting line and said shaft means in the third position being sufficient to apply a substantial braking force to said slider assembly and a load supported thereon during movement of the slider assembly along the load supporting line whereby a load may be lowered along the line at a safe, controlled rate without manual actuation of said handle means, said handle means being manually operable to move said shaft means from said intermediate position toward said first position to decrease such frictional contact and toward said second position to increase such frictional contact.

7. The load lowering mechanism according to claim 6 wherein said shaft means comprises a pair of parallel, vertically spaced shaft members each mounted for rotation about a generally horizontal axis and each having a line receiving opening extending substantially diametrically therethrough, and wherein said handle means is operable to rotate both of said shaft members simultaneously.

8. The load lowering mechanism according to claim 7 wherein said handle means comprises first and second link members rotably fixed one on one end of each said shaft member, and a third link member pivotly connected to said first and second link members, said first, second and third link members cooperating with said frame to define a parallel linkage.

9. The load lowering mechanism according to claim 8 wherein said parallel linkage is operable to rotate said first and second shaft members between a first position in which said line receiving openings extend in substantially vertical alignment with the load supporting line extending therethrough in a generally straight line and a second position in which said line receiving openings are substantially misaligned with the load supporting line following a zigzag path therethrough.

10. The load lowering mechanism according to claim 9 wherein said shaft members are rotated through an angle in excess of 90 degrees and less than 180 degrees during movement between said first and said second positions.

11. The load lowering mechanism according to claim 10 wherein said handle means further comprises means for adjusting the maximum angle of rotation of said shaft members.

12. The load lowering mechanism according to claim 11 wherein the load supporting line is a relatively thin flat belt and wherein the line receiving opening formed in said shaft members comprises an elongated thin slot extending through said shaft members and containing the axis of rotation thereof.

* * * * *